US009335665B2

(12) United States Patent
Fujihara

(10) Patent No.: US 9,335,665 B2
(45) Date of Patent: May 10, 2016

(54) IMAGE FORMING APPARATUS AND A METHOD FOR MEASURING DISCHARGE STARTING VOLTAGE

(71) Applicant: KYOCERA Document Solutions Inc., Osaka-shi, Osaka (JP)

(72) Inventor: Kensuke Fujihara, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 14/748,299

(22) Filed: Jun. 24, 2015

(65) Prior Publication Data

US 2015/0378281 A1 Dec. 31, 2015

(30) Foreign Application Priority Data

Jun. 30, 2014 (JP) ..... 2014-133587

(51) Int. Cl.
*G03G 15/09* (2006.01)
*G03G 15/06* (2006.01)

(52) U.S. Cl.
CPC ..... *G03G 15/0907* (2013.01); *G03G 15/065* (2013.01)

(58) Field of Classification Search
CPC .. G03G 15/065; G03G 15/0907; G03G 15/80
USPC ..... 399/55, 270, 282, 285
See application file for complete search history.

(56) References Cited

U.S. PATENT DOCUMENTS

| | | | | |
|---|---|---|---|---|
| 6,782,226 | B2 | 8/2004 | Machida et al. | |
| 7,813,658 | B2 | 10/2010 | Hamaya et al. | |
| 8,478,150 | B2 | 7/2013 | Fujihara et al. | |
| 2010/0129102 | A1 * | 5/2010 | Fujihara | G03G 15/065 399/55 |
| 2015/0104208 | A1 * | 4/2015 | Shimizu | G03G 15/065 399/55 |
| 2015/0261126 | A1 * | 9/2015 | Shimizu | G03G 15/0907 399/55 |

FOREIGN PATENT DOCUMENTS

| | | | |
|---|---|---|---|
| JP | H08185024 | A | 7/1996 |
| JP | 2003287942 | A | 10/2003 |
| JP | 2006126878 | A | 5/2006 |
| JP | 2008185976 | A | 8/2008 |
| JP | 2010113127 | A | 5/2010 |
| JP | 2010237348 | A * | 10/2010 |

* cited by examiner

*Primary Examiner* — Sophia S Chen

(57) ABSTRACT

An image forming apparatus includes an alternating transformer that splits an alternating voltage into a first alternating voltage and a second alternating voltage, a developer bias application unit, an alternating voltage shutoff unit, and a discharge starting voltage measurement unit. The developer bias application unit applies a pulsed sleeve roller voltage composed of a first alternating voltage superimposed on a first direct voltage to a sleeve roller and also applies a second alternating voltage and a second direct voltage separately to a magnetic roller in order to apply a pulsed magnetic roller voltage composed of the second alternating voltage superimposed on the second direct voltage. The alternating voltage shutoff unit stops applying the second alternating voltage to the magnetic roller. The discharge starting voltage measurement unit increases the alternating voltage of the alternating transformer to measure the discharge starting voltage between the sleeve roller and magnetic roller.

3 Claims, 7 Drawing Sheets

IMAGE FORMING APPARATUS AND A METHOD FOR MEASURING DISCHARGE STARTING VOLTAGE

INCORPORATION BY REFERENCE

The disclosure of Japanese Patent Application No. 2014-133587 filed on Jun. 30, 2014 including the specification, drawings and abstract is incorporated herein by reference in its entirety.

BACKGROUND

This disclosure relates to an image forming apparatus and a method for measuring discharge starting voltage, and more specifically to an image forming apparatus enabling proper measurement of discharge starting voltage by switching between voltage/current lines to a magnetic roller, and the method for measuring discharge starting voltage.

Conventionally, image forming apparatuses, such as copiers, multifunctional peripherals, and facsimiles, are equipped with many and various kinds of techniques to ensure the stability of the quality of image formation.

For example, well-known image forming apparatuses include a bias application unit that applies bias voltage to an image bearing member. One of the typical image forming apparatuses shuts off the bias voltage for the image bearing member, and the charges on the image bearing member are discharged through a grounding terminal via a resistance. This configuration can correct and control the potential accurately and stably with time and therefore can stabilize the quality of images.

There are also conventionally well-known development devices that include an image bearing member on which an electrostatic latent image is to be formed and a toner bearing member disposed in a development area so as to face the image bearing member with required spacing. In the development devices, a developer bias voltage composed of a direct voltage superimposed on an alternating voltage is applied between the toner bearing member and image bearing member to supply the toner on the toner bearing member to the image bearing member, thereby developing an electrostatic latent image. One of the typical development devices is provided with a leaking unit that causes leakage between the aforementioned image bearing member and toner bearing member by varying a leak detection voltage applied between the image bearing member and toner bearing member, and a leak detection unit that detects leakage based on current flowing between the image bearing member and toner bearing member. This development device does not need conventionally-used expensive density sensors to detect leakage, thereby reducing the cost, and can reliably detect leakage that occurs in any positions.

Other conventionally well-known development devices include an image bearing member having a thin film layer made of an organic photoconductor material on its surface. The development devices are used in image forming operations to form an image on a recording sheet, the image forming operations including exposing the image bearing member to light to form an electrostatic latent image, and then causing developer to adhere to the electrostatic latent image to visualize the image. The development devices also include a developer bearing member that carries developer to be supplied to the image bearing member, and is configured to apply voltage to the developer bearing member to supply developer from the developer bearing member to the image bearing member. One of the typical development devices employs one-component developer and includes a detection unit that detects voltage, prior to image forming operation, when leakage occurs between the developer bearing member and the thin film layer, and a setting unit that defines the range of the voltage that does not cause leakage based on the detection results of the detection unit. Even if the spacing between the developer bearing member and image bearing member varies from device to device, or if it is changed, this development device can secure a wide allowable range of developer bias voltage and can reliably prevent leakage from occurring between the developer bearing member and image bearing member. In addition, preventing the leakage results in constant formation of excellent images.

Other conventional well-known image forming apparatuses include a photoconductor that carries an electrostatic latent image, a charging device that has a charging wire extending in parallel with an axis of the photoconductor and charges the photoconductor, a detection unit that detects leak current of the charging device, and at least one of a cleaning unit that cleans the charging wire when the detection unit detects leak current and a replacement unit that replaces the charging wire when the detection unit detects leak current. In these image forming apparatuses, the charging device includes a promoting unit that promotes leakage of the charging device and is situated at a position other than positions facing the image formation area in which the electrostatic latent image is formed. Since the charging wire is at least cleaned or replaced when a leak current occurs by the promoting unit, it is possible to prevent the progress of wire thickening, and therefore it is possible to suppress leakage which adversely influences the electrostatic latent image formed on the photoconductor. In addition, since the promoting unit is situated at a position other than positions facing the image formation area in which the electrostatic latent image is formed, the adverse affects caused by the leak current that occurs by the promoting unit on the electrostatic latent image can be reduced.

Furthermore, other conventional well-known image forming apparatuses include an image forming unit and a detection unit. The image forming unit includes a photoconductive drum that is rotatably supported and is rotated with a driving force from a driving source, a developer roller that carries charged toner, is connected to a first voltage application unit for outputting alternating voltage, and supplies toner to the photoconductive drum, a development device that supplies toner to the developer roller and supports the developer roller so as to face the photoconductive drum with a gap therebetween, and a contact member that abuts against the photoconductive drum to remove residual toner. The detection unit detects discharge between the developer roller and the photoconductive drum. In one of the typical image forming apparatuses, the development device supplies toner to the developer roller with prescribed timing and for a prescribed period of time during discharge detection in which, while the photoconductive drum rotates and the first voltage application unit stepwise varies a peak-to-peak voltage of an alternating voltage applied to the developer roller, a voltage at which discharge occurs between the photoconductive drum and the developer roller is detected. This image forming apparatus does not need to have the developer roller carry the toner thereon all the time during discharge detection, and therefore can achieve stabilization of the voltage at which electric discharge occurs, thereby reliably measuring discharge starting voltage with high accuracy. Furthermore, since the image forming apparatus supplies toner to the developer roller and the photoconductive drum with constant timing, an excessive rise in toner potential at the contact member can be prevented, and the photoconductive drum can be thereby protected from damage.

SUMMARY

In an aspect of the present disclosure, the image forming apparatus includes an alternating transformer that splits a given alternating voltage into a first alternating voltage and a second alternating voltage. The image forming apparatus includes a developer bias application unit, an alternating voltage shutoff unit, and a discharge starting voltage measurement unit. During image formation, the developer bias application unit applies to a sleeve roller a pulsed sleeve roller voltage composed of a first alternating voltage superimposed on a first direct voltage, and also applies to a magnetic roller a second alternating voltage and a second direct voltage separately in order to apply to the magnetic roller a pulsed magnetic roller voltage composed of the second alternating voltage superimposed on the second direct voltage. The alternating voltage shutoff unit stops applying the second alternating voltage to the magnetic roller before measurement of discharge starting voltage. When the application of the second alternating voltage to the magnetic roller is stopped, the discharge starting voltage measurement unit increases the alternating voltage of the alternating transformer to measure the discharge starting voltage between the sleeve roller and magnetic roller.

DETAILED DESCRIPTION

With reference to the accompanying drawings, an embodiment of the image forming apparatus according to the present disclosure will be described for further understanding of the disclosure. It should be noted that the embodiment described below is a mere example of implementation of the present disclosure, and in no way restricts the technical scope of the disclosure. The alphabetic script "S" attached before a numeral in the flowchart means "step".

<Image Forming Apparatus>

Figure 1:
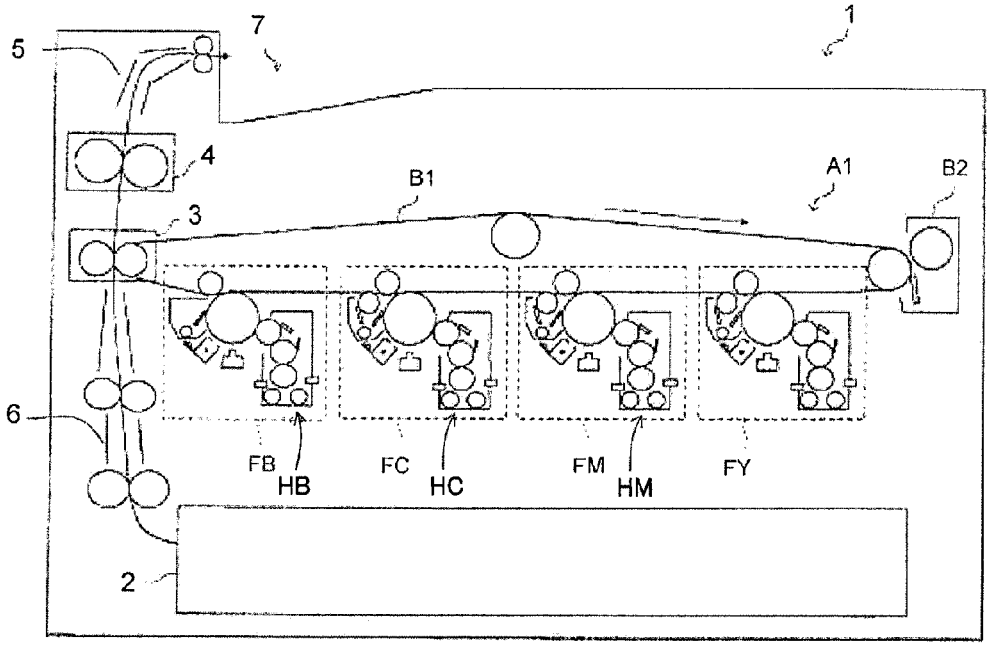
FIG. 1 is a schematic view showing the configuration of an image forming apparatus according to an embodiment.

A description will be made below about an image forming apparatus 1 according to the disclosure. FIG. 1 is a schematic view showing the configuration of the image forming apparatus 1 according to an embodiment.

The image forming apparatus 1 includes a tandem-type image forming section A1 that forms toner images according to image data, a sheet storage section 2 that stores sheets of paper, and a secondary transfer section 3 that transfers toner images formed by the image forming section A1 onto sheets. The image forming apparatus 1 further includes a fusing section 4 that fixes the transfered toner images on the sheets, a sheet ejection device 5 that ejects the sheets on which the toner images are completely fixed, and an output tray 7 that receives the ejected sheets. Furthermore, the image forming apparatus 1 includes a sheet transport section 6 that delivers sheets from the sheet storage section 2 to the sheet ejection device 5.

The image forming section A1 includes an intermediate transfer belt B1 (intermediate transfer member), a cleaning section B2 for the intermediate transfer belt B1, and image forming units FY, FM, FC, and FB respectively associated with the following colors, yellow (Y), magenta (M), cyan (C), and black (B).

The intermediate transfer belt B1 is a belt member that is electrically conductive, has a usable length, which is perpendicular to a sheet transportation direction, being greater than the width of a sheet of the maximum size, and has no end, that is, is formed into a loop. The intermediate transfer belt B1 is driven to circulate clockwise in FIG. 1.

The image forming units FY, FM, FC, and FB are arranged along the intermediate transfer belt B1 in this order in a downstream area with respect to the cleaning section B2 for the intermediate transfer belt B1, but in an upstream area with respect to the secondary transfer section 3 in the direction to which the intermediate transfer belt B1 moves. It is not limited to this order of the arrangement of the image forming units FY, FM, FC, FB; however, this arrangement is preferable in consideration of the impact of color blending on the finished image. The image forming units FY, FM, FC, FB are spaced at equal intervals.

Figure 2:
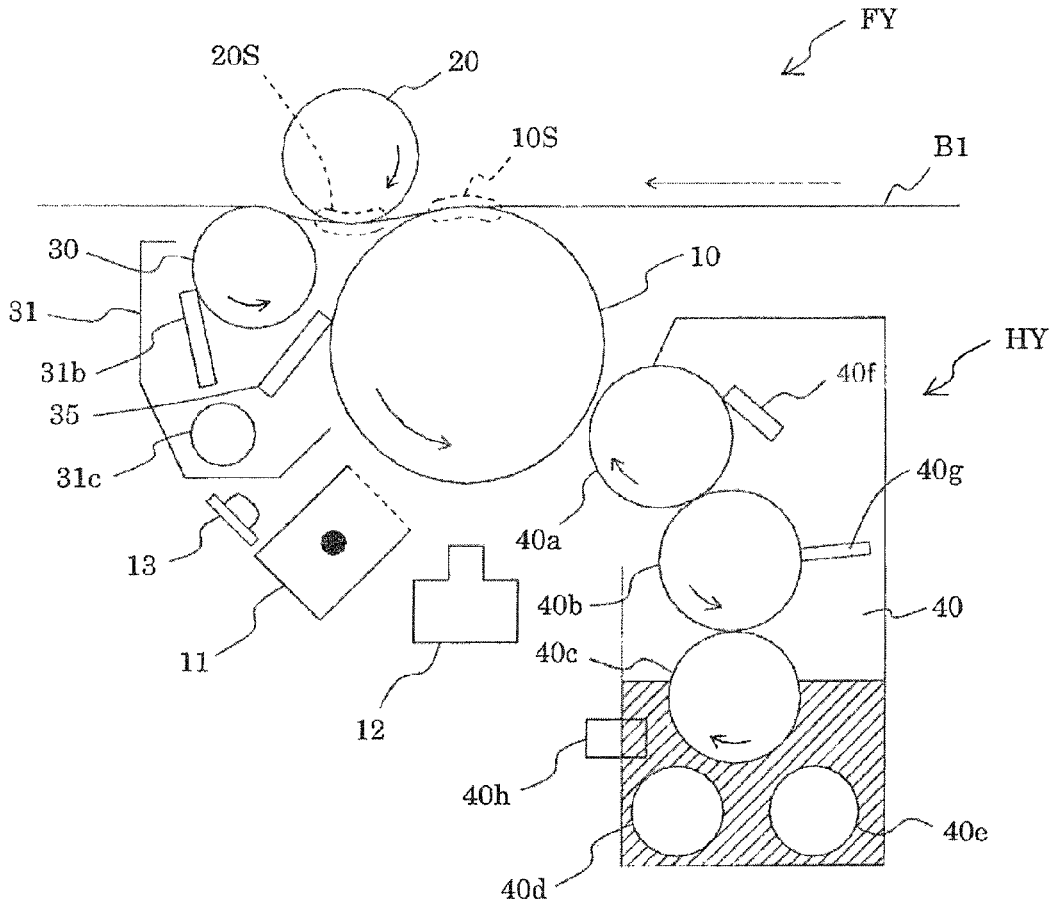
FIG. 2 is a detailed view of one of image forming units.

Next, a description will be made about image forming operation of the image forming apparatus 1. FIG. 2 is a detailed view of one of the image forming units FY, FM, FC, and FB. The image forming units FY, FM, FC, FB have almost the same configuration.

The image forming unit FY includes a photoconductive drum (image bearing member) 10, a charging device 11, an LED exposure device 12, a development device HY for yellow, a primary transfer roller (voltage applying portion) 20, a cleaning blade 35 for the photoconductive drum 10, a discharging device 13, and a carrier removal roller (carrier removing member) 30.

The other image forming units FM, FC, FB include development devices HM, HC, HB, respectively, associated with their own colors. Among the image forming units, the image forming unit FB, which is located on the most downstream side in the direction to which the intermediate transfer belt B1 moves, is not provided with a carrier removal roller 30 because there is no image forming unit in the downstream side with respect to the image forming unit FB, but the image forming unit FB has the same configuration as the others except for that.

The photoconductive drum 10 can be any type of photoconductive drum as long as it is capable of bearing on its surface toner images containing charged toner (to negative polarity in this embodiment).

In this embodiment, the photoconductive drum 10 is a roughly cylindrical member disposed rotatably about its rotation axis, which is perpendicular to the direction to which the intermediate transfer belt B1 moves and is in parallel with the plane of the intermediate transfer belt B1. In addition, the photoconductive drum 10 is configured to abut against a surface of the intermediate transfer belt B1 at a predetermined primary transfer position 10S. The photoconductive drum 10 can rotate in the same direction as the moving direction of the intermediate transfer belt B1 at the primary transfer position 10S, that is, the photoconductive drum 10 can rotate counter-clockwise in FIG. 2.

The cleaning blade 35, discharging device 13, charging device 11, exposure device 12, and development device HY for yellow are arranged in this order with respect to the primary transfer position 10S along the rotational direction around the photoconductive drum 10.

The charging device 11 can uniformly charge a surface of the photoconductive drum 10. The exposure device 12 includes a light source, such as an LED, and can illuminate the surface of the photoconductive drum 10 with light in accordance with image data from a host apparatus, such as a personal computer (PC), to form an electrostatic latent image on the surface of the photoconductive drum 10.

The development device HY for yellow holds developer, which contains yellow toner and carrier, so as to face the electrostatic latent image to apply the toner to the electrostatic latent image, thereby developing the electrostatic latent image into a toner image. The toner image is primarily-transferred to the intermediate transfer belt B1 by the primary transfer roller 20. The details of the primary transfer roller 20 will be described later.

The cleaning blade 35 is a blade-like member disposed so as to make contact with the photoconductive drum 10. After primary transfer, the cleaning blade 35 removes residual developer from the surface of the photoconductive drum 10.

The discharging device 13 includes a light source and discharges the surface of the photoconductive drum 10 with light from the light source after the removal of the developer by the cleaning blade 35, for the purpose of preparing for the next image formation.

The primary transfer roller 20 is disposed so as to abut against the back surface of the intermediate transfer belt B1 at a voltage application position 20S, which is located on the downstream side with respect to the primary transfer position 10S in the moving direction of the intermediate transfer belt B1. The primary transfer roller 20 is applied from a light source (not shown) with voltage of a polarity opposite to the polarity of the toner in the toner image (negative polarity in this embodiment). In other words, the primary transfer roller 20 can apply the voltage of a polarity opposite to the toner onto the intermediate transfer belt B1 at the voltage application position 20S. Since the intermediate transfer belt B1 has electrical conductivity, the applied voltage attracts toner to the surface, and its surroundings, of the intermediate transfer belt B1 at the voltage application position 20S.

Thus, the primary transfer position 10S in this embodiment is located within a range where the toner is attracted toward the intermediate transfer belt B1 by the application of voltage. Consequently, the toner is transferred from the photoconductive drum 10 to the front surface of the intermediate transfer belt B1, and thus primary transfer is executed.

If execution of primary transfer is possible as described above, the detailed configurations of the primary transfer roller 20 are not particularly limited, and therefore can be modified as appropriate. In this embodiment, the primary transfer roller 20 is a roughly cylindrical member that is rotatable about its rotation axis in parallel with the rotation axis of the photoconductive drum 10 in a rotational direction opposite to that of the photoconductive drum 10. In other words, the primary transfer roller 20 is rotatable in the same moving direction as that of the intermediate transfer belt B1 at the charge application position 20S.

The carrier removal roller 30 in this embodiment is a roughly cylindrical member that is rotatable about its rotation axis in parallel with the rotation axis of the photoconductive drum 10 in the same direction as that of the photoconductive drum 10; however, the carrier removal roller 30 is not limited thereto and can be anything as long as it can remove carrier from the front surface of the intermediate transfer belt B1 in a downstream area with respect to the voltage application position 20S, but in an upstream area with respect to the secondary transfer position along the moving direction of the intermediate transfer belt B1. More specifically, the carrier removal roller 30 is preferably configured to make contact with the front surface of the intermediate transfer belt B1 to move the carrier on the front surface of the intermediate transfer belt B1 to its own surface.

During the primary transfer, a small amount of carrier may be transferred with toner from the photoconductive drum 10 to the intermediate transfer belt B1. This carrier transfer may obstruct primary transfer executed in the downstream image forming units, thereby causing defects in images, such as blurs and smears. The carrier removal roller 30 can prevent these defects in images.

In this embodiment, the carrier removal roller 30 is disposed so as to abut against the front surface of the intermediate transfer belt B1 at a position in a downstream area with respect to the voltage application position 20S in the moving direction of the intermediate transfer belt B1. The carrier removal roller 30 is mounted inside a cleaning unit 31 together with the aforementioned cleaning blade 35. The cleaning unit 31 is provided in the image forming unit FY, and includes in addition to the cleaning blade 35 and carrier removal roller 30, a carrier removal blade 31*b* that removes carrier adhered to the surface of the carrier removal roller 30 by abutting against the surface of the carrier removal roller 30, and a conveyance member 31*c* that conveys carrier removed from the carrier removal roller 30 and developer (containing toner and carrier) removed from the surface of the photoconductive drum 10 by the cleaning blade 35 to the outside of the cleaning unit 31. Furthermore, the image forming unit FY can include a separator or the like that separates the toner from the carrier for the purpose of reusing the carrier and toner conveyed by the conveyance member 31*c*.

Next, the configuration of the development device HY will be described. The development devices HY, HM, HC, HB prepared for respective colors are configured equally.

The development device HY includes a developer container 40, a developer roller (sleeve roller) 40*a*, a magnetic roller (mag roller) 40*b*, a drawing roller 40*c*, spiral agitators 40*d*, 40*e*, a cleaning blade 40*f*, and a magnetic-roller doctor blade 40*g*.

The developer container 40 stores developer made of yellow toner (toner particles) and carrier. The spiral agitators 40*d* and 40*e* are disposed so as to be entirely immersed in the developer in the developer container 40 to agitate the developer. Rotation of the spiral agitators 40*d*, 40*e* spreads toner uniformly around the carrier.

The drawing roller 40*c* is disposed so as to be partially immersed in the developer in the developer container 40 to draw up the developer adhered to its own surface. The magnetic roller 40*b* is disposed in contact with the drawing roller 40*c* to receive the developer supplied from the drawing roller 40*c*. The magnetic-roller doctor blade 40*g* is disposed on a downstream side of the rotational direction of the magnetic roller 40*b* with respect to the contact point of the magnetic roller 40*b* and drawing roller 40*c* in order to regulate the thickness of the layer of developer on the surface of the magnetic roller 40*b*. The magnetic-roller doctor blade 40*g* maintains the developer layer on the surface of the magnetic roller 40*b* at a predetermined thickness. The developer roller 40*a* (also referred to as a developer device) is disposed in contact with the magnetic roller 40*b* to receive on its own surface the developer supplied from the magnetic roller 40*b*. Since the thickness of the developer on the magnetic roller 40*b* is regulated to be the predetermined thickness, the thickness of the developer layer formed on the surface of the developer roller 40*a* is also maintained at the predetermined thickness. The developer roller 40*a* and the photoconductive drum 10 abut against each other and produce a potential difference between the potential of the electrostatic latent image on the surface of the photoconductive drum 10 and the potential of a developer bias applied to the developer roller 40*a*. This potential difference forms a toner image, which corresponds to an image to be formed according to an instruction from a host apparatus, on the surface of the photoconductive drum 10 (developing operation).

The image forming apparatus according to the present disclosure is characterized in that image density correction is performed on the toner image by adjusting the developer bias value (or a voltage value, or simply a bias value) to be applied to the developer roller 40*a*.

After the developer roller 40*a* finishes the developing operation for the photoconductive drum 10, the developer on the surface of the developer roller 40*a* is removed by the cleaning blade 40*f* and flows down along a surface of the cleaning blade 40*f* through a flow path (not shown) to mix with the developer stored in the developer container 40.

The developer container 40 is provided with a toner density sensor 40*h* that detects the toner density of the developer in the developer container 40. If a toner density lower than a predetermined value is detected, toner (developer with a toner density higher than the predetermined value) is supplied from a toner cartridge (not shown) to the developer container 40, while if the toner density is higher than the predetermined value, carrier is supplied from a carrier cartridge (not shown) to the developer container 40.

Upon receipt of an instruction from a host apparatus, e.g., a personal computer (PC), to form an image, the image forming apparatus 1 configured as described above forms toner images of different colors corresponding to the image data to be formed under the instruction, using the image forming units FY, FM, FC, FB. The toner images formed by the respective image forming units are transferred onto the intermediate transfer belt B1 and laid over each other on the intermediate transfer belt B1 to obtain a color toner image.

In synchronization with formation of this color toner image, sheets of paper accommodated in a sheet storage section 2 are taken out one by one from the sheet storage section 2 by a paper feeding device (not shown) and conveyed through the sheet transport section 6. The sheet is sent to the secondary transfer section 3 in time for primary transfer of the color toner image onto the intermediate transfer belt B1, and then the color toner image on the intermediate transfer belt B1 is secondary-transferred onto the sheet in the secondary transfer section 3. The sheet with the color toner image transferred thereon is further sent to the fusing section 4 where the color toner image is fixed on the sheet by heat and pressure. The sheet is ejected to an output tray 7 provided outside of the image forming apparatus 1 by a sheet ejection device 5. After the secondary transfer, residual toner on the intermediate transfer belt B1 is removed from the intermediate transfer belt B1 by the cleaning section B2 of the intermediate transfer belt B1.

Figure 3:
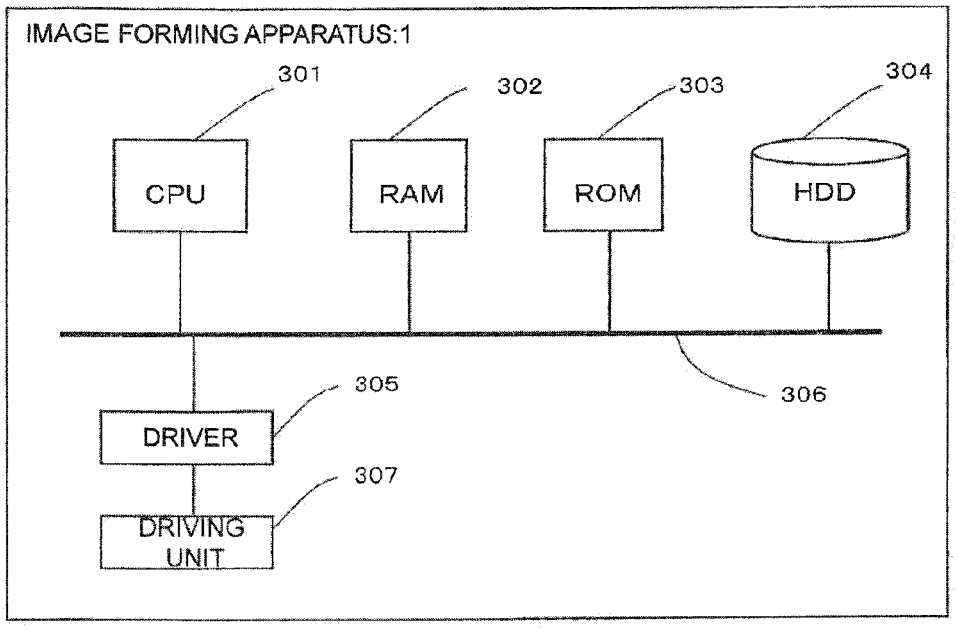
FIG. 3 is a schematic view showing the configuration of control-related components of the image forming apparatus according to the embodiment.

FIG. 3 is a schematic view showing the configuration of control-related components of the image forming apparatus 1 according to the embodiment.

The image forming apparatus 1 includes a central processing unit (CPU) 301, a random access memory (RAM) 302, a read only memory (ROM) 303, a hard disk drive (HDD) 304, and a driver 305 associated with each driving unit 307 for printing, those being connected by an internal bus 306. The CPU 301, for example, uses the RAM 302 as a work area and executes programs stored in the ROM 303, HDD 304, or other storage devices. Based on the program execution results, the CPU 301 exchanges data and instructions with the driver 305 to control the operation of the respective driving units shown in FIG. 1. The CPU 301 also implements other units (see FIG. 4), which will be described later, in addition to the aforementioned driving units, by executing the programs.

EMBODIMENT OF THE ENCLOSURE

Figure 4:
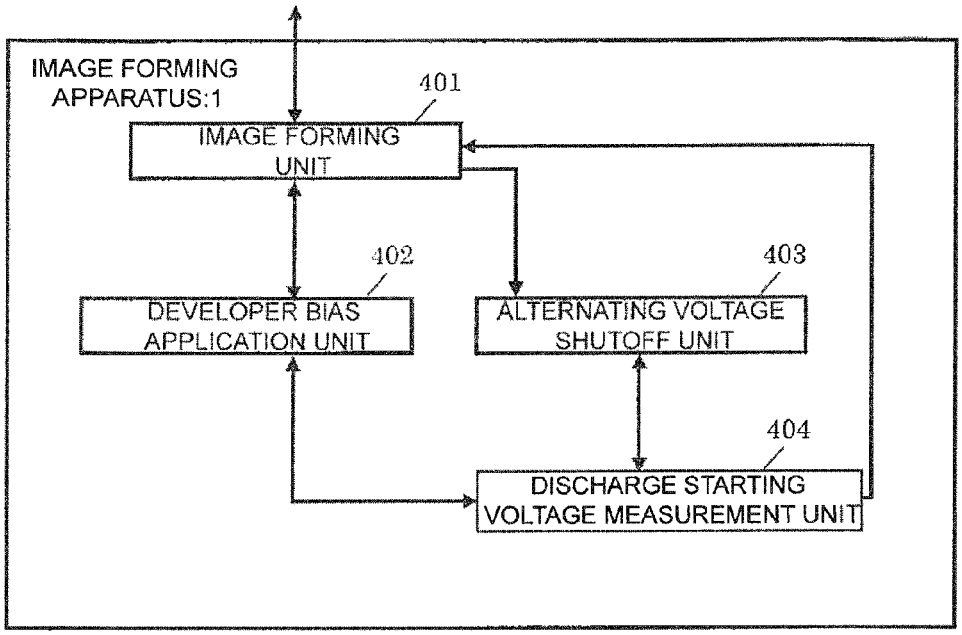
FIG. 4 is a functional block diagram of the image forming apparatus according to the present disclosure.
Figure 5:
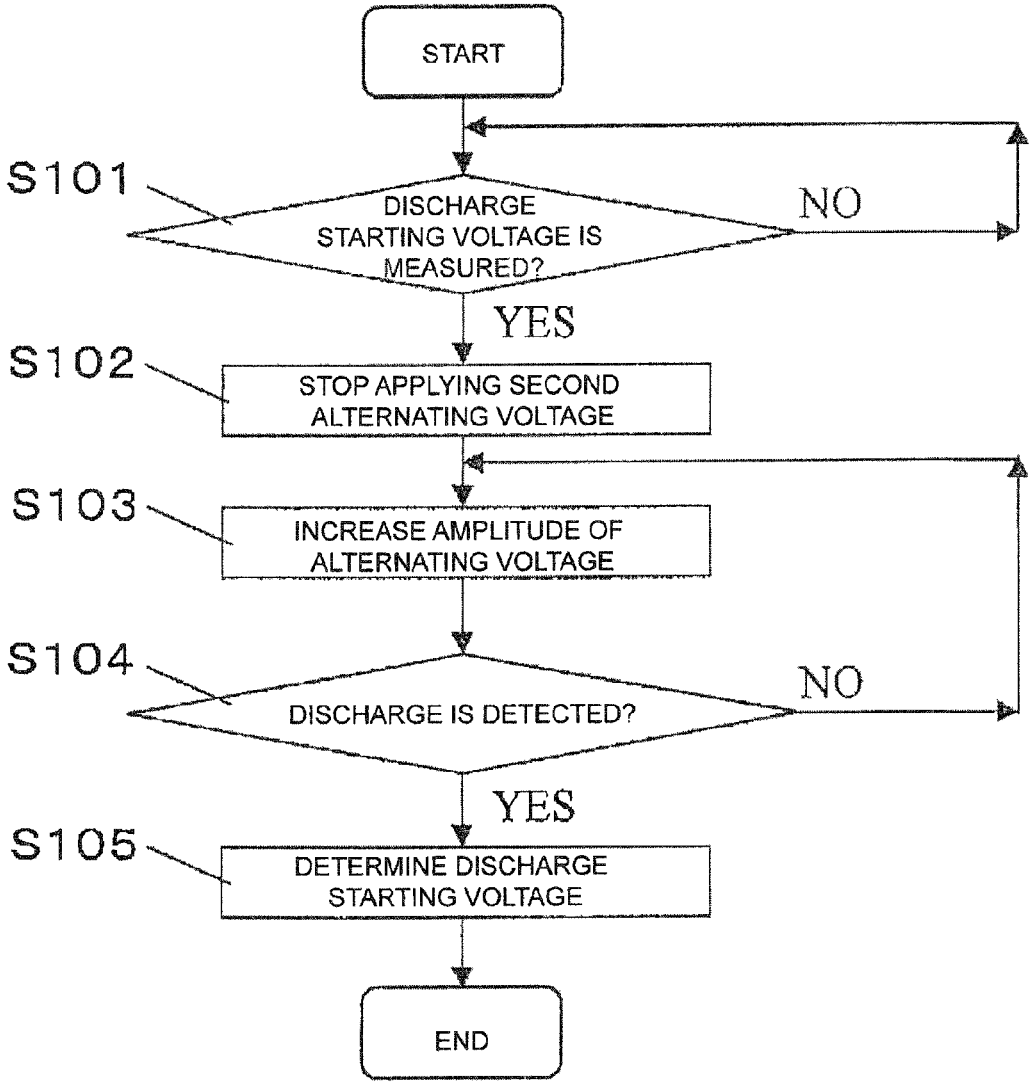
FIG. 5 is a flow chart describing an execution procedure according to the disclosure.

With reference to FIGS. 4 and 5, a description will be given about the configuration and execution procedure according to the embodiment of the present disclosure. FIG. 4 is a functional block diagram of the image forming apparatus of the disclosure. FIG. 5 is a flow chart describing the execution procedure of the disclosure.

Firstly, when a user turns on the power of the image forming apparatus 1, an image forming unit 401 of the image forming apparatus 1 brings the image forming apparatus 1 into an image formable state. The transition processing to the image formable state includes, for example, initialization of setting conditions, execution of calibration, and so on.

Once the image forming apparatus 1 enters the image formable state, the user sends required image data and an instruction to form an image of the image data from a host apparatus (terminal device), such as a PC, to the image forming apparatus 1. Then, the image forming unit 401 of the image forming apparatus 1 executes image forming processing in accordance with the image data.

Prior to execution of image formation processing, the image forming unit 401 notifies a developer bias application unit 402 that it will form an image. In response to the notification, the developer bias application unit 402 applies to a sleeve roller 40*a* a pulsed sleeve roller voltage composed of a first alternating voltage superimposed on a first direct voltage, and also applies to a magnetic roller 40*b* a second alternating voltage and a second direct voltage separately in order to apply to the magnetic roller 40*b* a pulsed magnetic roller voltage composed of the second alternating voltage superimposed on the second direct voltage.

The magnetic roller voltage has falling portions corresponding to rising portions of the pulses of the sleeve roller voltage and rising portions corresponding to falling portions of the pulses of the sleeve roller voltage. The sleeve roller voltage and the magnetic roller voltage produce a constant developer bias voltage between the sleeve roller 40*a* and the magnetic roller 40*b* as a surface potential.

The method in which the developer bias application unit 402 applies the sleeve roller voltage to the sleeve roller 40*a* as well as applies the second alternating voltage and second direct voltage separately to the magnetic roller 40*b* can be any methods; however, the following method may be employed.

Figure 6:
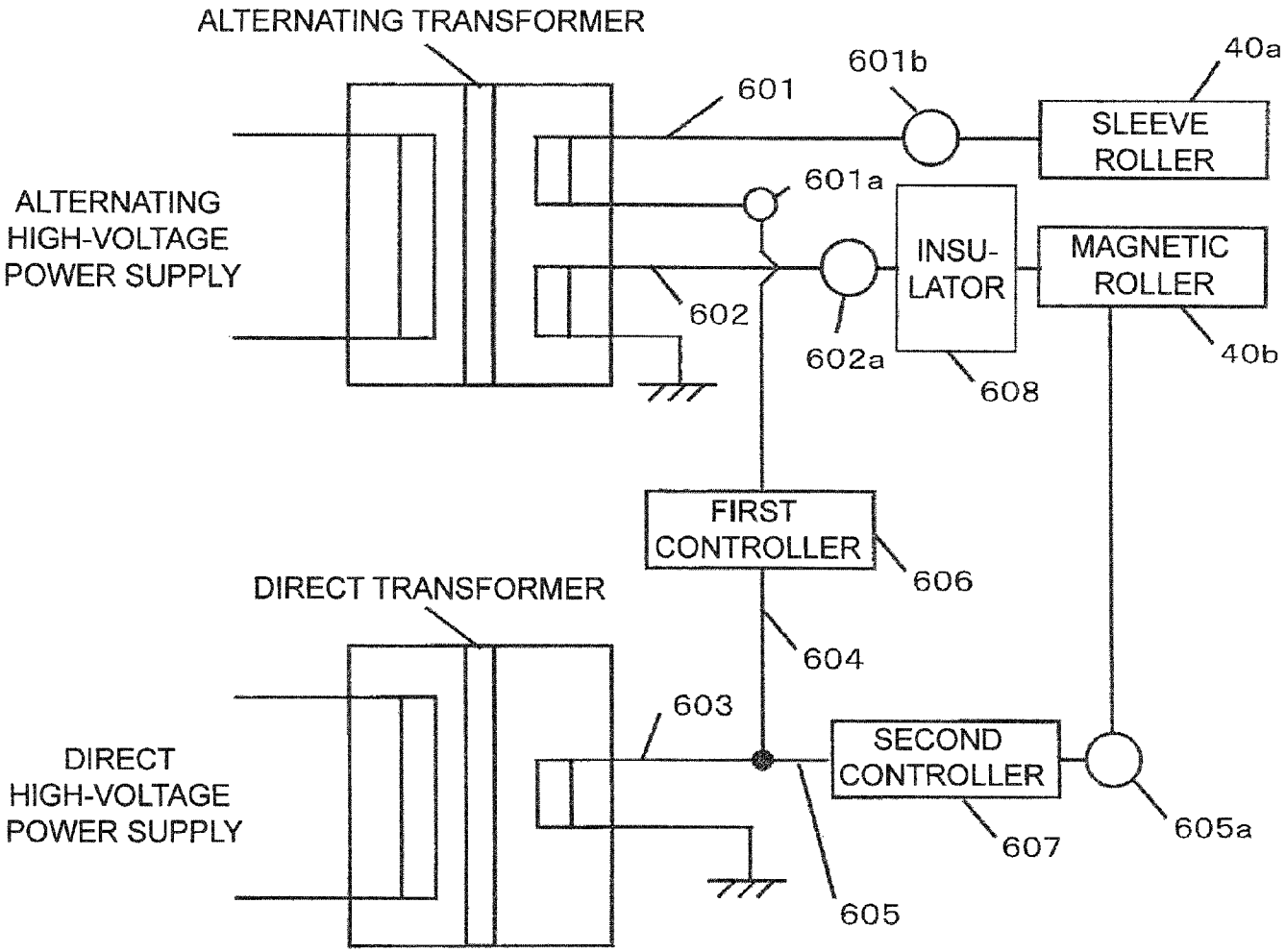
FIG. 6 illustrates a configuration of an alternating voltage/direct voltage power supply in the image forming apparatus according to the disclosure.

For example, an alternating voltage/direct voltage power supply in the image forming apparatus 1 is configured as shown in FIG. 6. First, a given alternating high-voltage power supply is provided with an alternating transformer to split an alternating voltage of the alternating high-voltage power supply to a sleeve roller voltage line 601 through which voltage is fed to the sleeve roller 40*a* and a magnetic roller alternating voltage line 602 through which alternating voltage is fed to the magnetic roller 40*b*. The magnetic roller alternating voltage line 602 has an input terminal that is grounded.

Next, a given direct high-voltage power supply is provided with a direct transformer to feed a direct voltage of the direct high-voltage power supply to a single direct voltage line 603 that branches off into two direct voltage lines 604 and 605. The direct voltage line 603 has an input terminal that is grounded.

The direct voltage line 604 is electrically connected to an input terminal 601*a* (an input terminal located before the alternating transformer) of the sleeve roller voltage line 601 through a first controller 606 that controls direct voltage for the sleeve roller 40*a*.

Thus, the sleeve roller voltage line 601 is applied with a direct voltage from the direct voltage line 604 and is also applied with a predetermined alternating voltage (first alternating voltage) from the alternating transformer, and therefore the output terminal 601*b* of the sleeve roller voltage line 601 outputs a pulsed sleeve roller voltage composed of the first alternating voltage superimposed on the first direct voltage. The pulsed sleeve roller voltage composed of the first alternating voltage superimposed on the first direct voltage is applied to the sleeve roller 40*a* by electrically connecting the output terminal 601*b* of the sleeve roller voltage line 601 to the sleeve roller 40*a*.

On the other hand, the direct voltage line 605 has an output terminal 605*a* that is electrically connected to the magnetic roller 40*b* through a second controller 607 that controls direct voltage for the magnetic roller 40*b*. Furthermore, the magnetic roller alternating voltage line 602 has an output terminal 602*a* that is not electrically connected to the direct voltage line 605, but is electrically connected to the magnetic roller 40*b*. The output terminal 605*a* of the direct voltage line 605 and the output terminal 602*a* of the magnetic roller alternating voltage line 602 are electrically connected to the magnetic roller 40*b* separately, and therefore an alternating voltage (second alternating voltage) from the magnetic roller alternating voltage line 602 and a direct voltage (second direct voltage) from the direct voltage line 605 are applied to the magnetic roller 40*b* separately, and thereby a pulsed magnetic roller voltage composed of the second alternating voltage superimposed on the second direct voltage is to be applied to the magnetic roller 40*b*.

Incidentally, a given insulator 608 is provided between the output terminal 602*a* of the magnetic roller alternating voltage line 602 and the magnetic roller 40*b* so as to electrically connect or disconnect between the output terminal 602*a* of magnetic roller alternating voltage line 602 and the magnetic roller 40*b*.

Figure 7A:
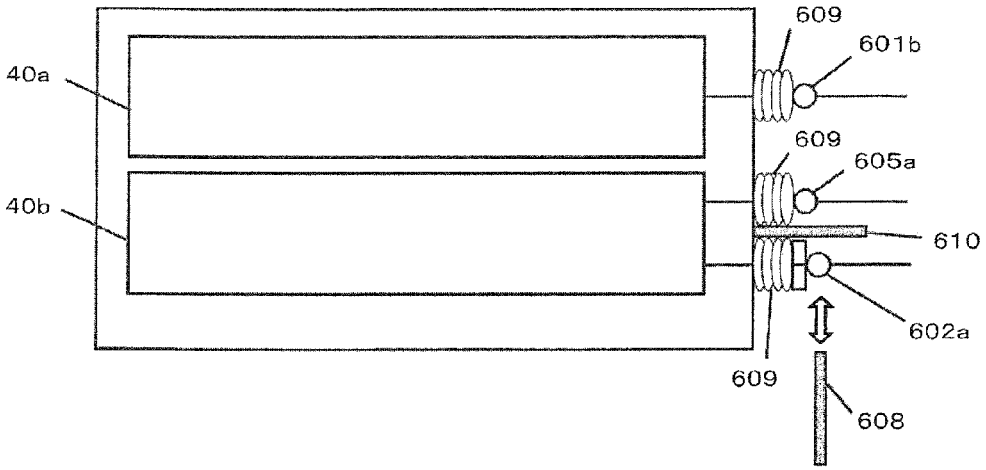
FIG. 7A illustrates a magnetic roller of the image forming apparatus according to the disclosure, the magnetic roller being electrically connected to voltage lines.

During image formation processing, the developer bias application unit 402 uncouples the insulator 608 as shown in FIG. 7A to electrically connect the output terminal 602*a* of the magnetic roller alternating voltage line 602 to the magnetic roller 40*b*, thereby applying a second alternating voltage to the magnetic roller 40*b*.

As shown in FIG. 7A, the output terminal 601*b* of the sleeve roller voltage line 601 is electrically connected to the sleeve roller 40*a* via a coil spring 609, while the output terminal 605*a* of the direct voltage line 605 and the output terminal 602*a* of the magnetic roller alternating voltage line 602 are electrically connected to the magnetic roller 40*b* separately via respective coil springs 609. A given insulating member 610 is provided between the direct voltage line 605 and the magnetic roller alternating voltage line 602 as a shield in advance to reliably break the electrical connection between the direct voltage line 605 and the magnetic roller alternating voltage line 602.

After the developer bias application unit 402 applies the sleeve roller voltage to the sleeve roller 40*a* and applies the second alternating voltage and second direct voltage separately to the magnetic roller 40*b*, the image forming unit 401 performs image forming processing.

Upon completion of the image forming processing by the image forming unit 401, it is determined whether to measure a discharge starting voltage associated with the application of a developer bias voltage (S101 in FIG. 5).

The image forming unit 401 can use any methods to determine whether or not to measure the discharge starting voltage, but it can determine, for example, under the following conditions: whether or not it is immediately after replacement of the sleeve roller 40*a* and magnetic roller 40*b* of the development device; whether or not the total number of prints resulting from image formation exceeds a preset first threshold value (e.g., 100 prints); whether or not the temperature measured by a thermometer provided to the image forming apparatus 1 exceeds a preset second threshold (e.g., 30 degrees); or whether or not the humidity measured by a hygrometer provided to the image forming apparatus 1 exceeds a preset third threshold (e.g., 60%). Incidentally, the measurement of the discharge starting voltage can be performed when the image forming apparatus enters the aforementioned image formable state.

If it is determined not to measure the discharge starting voltage as a result of the determination (NO at S101 in FIG. 5), the image forming unit 401 continuously executes image forming processing under a user's image forming instruction.

On the other hand, if it is determined to measure the discharge starting voltage as a result of the determination (YES at S101 in FIG. 5), the image forming unit 401 notifies the alternating voltage shutoff unit 403 of the determination, and the alternating voltage shutoff unit 403 that received the notification stops applying (supplying) the second alternating voltage to the magnetic roller 40*b* (S102 in FIG. 5).

Figure 7B:
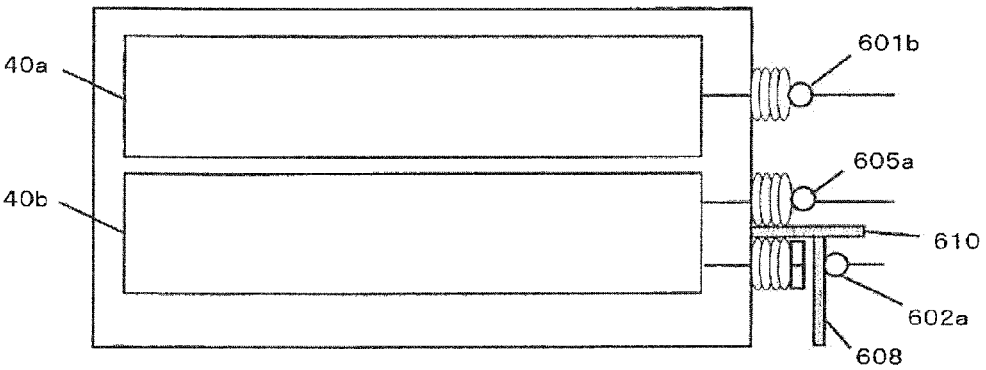
FIG. 7B illustrates the magnetic roller of the image forming apparatus according to the disclosure, the magnetic roller being electrically connected to only a direct voltage line.

The alternating voltage shutoff unit 403 can use any methods to stop applying the second alternating voltage to the magnetic roller 40*b*. For example, as shown in FIG. 7B, the alternating voltage shutoff unit 403 can electrically disconnect the output terminal 602*a* of the magnetic roller alternating voltage line 602 from the magnetic roller 40*b* by inserting (utilizing the function of) the insulator 608 provided between the magnetic roller 40*b* and the output terminal 602*a* of the magnetic roller alternating voltage line 602.

According to the above method, even if the amplitude of alternating voltage to be applied to the sleeve roller voltage line 601 is increased by controlling the alternating transformer, which splits the alternating voltage to deliver it to the magnetic roller alternating voltage line 602 for the magnetic roller 40*b*, the increased alternating voltage is applied to only the sleeve roller 40*a*, but not to the magnetic roller 40*b*.

Once the alternating voltage shutoff unit 403 stops applying the second alternating voltage to the magnetic roller 40*b*, it notifies a discharge starting voltage measurement unit 404 that the alternating voltage is shut off. The discharge starting voltage measurement unit 404 receives the notification and increases alternating voltage of the alternating transformer to measure the discharge starting voltage that occurs between the sleeve roller 40*a* and the magnetic roller 40*b*.

The discharge starting voltage measurement unit 404 can use any methods to measure the discharge starting voltage. For example, the discharge starting voltage measurement unit 404 starts detecting current (discharge) flowing between the sleeve roller 40*a* and the magnetic roller 40*b* (S104 in FIG. 5), while gradually increasing the amplitude of the alternating voltage of the alternating transformer (S103 in FIG. 5).

If the current flowing between the sleeve roller 40*a* and the magnetic roller 40*b* is not detected (No at S104 in FIG. 5), the process returns to S103, and the discharge starting voltage measurement unit 404 continues increasing the amplitude of the alternating voltage of the alternating transformer.

As described above, even if the amplitude of alternating voltage to be applied to the sleeve roller voltage line 601 is increased, the alternating voltage is not applied to the magnetic roller 40*b*, thereby reliably preventing toner from being supplied to the magnetic roller 40*b* and reliably preventing leakage between the magnetic roller 40*b* and the sleeve roller 40*a*. In addition, there is no need to provide a shutter or the like between the magnetic roller 40*b* and sleeve roller 40*a*.

If the alternating voltage of the alternating transformer is increased to, for example, approximately 1500 V and then a current flows between the sleeve roller 40*a* and the magnetic roller 40*b* (YES at S104 in FIG. 5), the discharge starting voltage measurement unit 404 detects the current (discharge) and determines the alternating voltage of the alternating transformer at this point as a discharge starting voltage (S105 in FIG. 5).

Thus, the aforementioned leakage does not occur, and therefore the discharge starting voltage can be correctly measured.

When the discharge starting voltage measurement unit 404 determines the discharge starting voltage, the discharge starting voltage measurement unit 404 notifies the image forming unit 401 of the determination. In image forming processing to be performed from then on, the image forming unit 401 produces developer bias voltage using the discharge starting voltage. In this case, this correct discharge starting voltage can help supply appropriate developer bias voltage, thereby providing images of high quality.

As described above, this disclosure is characterized by including the developer bias application unit 402 that, during image formation, applies to the sleeve roller 40*a* a pulsed sleeve roller voltage composed of a first alternating voltage superimposed on a first direct voltage and also applies to the magnetic roller 40*b* a second alternating voltage and a second direct voltage separately in order to apply a pulsed magnetic roller voltage composed of the second alternating voltage superimposed on the second direct voltage to the magnetic roller 40*b*, the alternating voltage shutoff unit 403 that stops applying the second alternating voltage to the magnetic roller 40*b* before measurement of discharge starting voltage, and the discharge starting voltage measurement unit 404 that when the application of the second alternating voltage to the magnetic roller 40*b* is stopped, increases the alternating voltage of the alternating transformer to measure the discharge starting voltage that occurs between the sleeve roller 40*a* and magnetic roller 40*b*.

Thus, discharge starting voltage can be correctly measured by switching between the voltage/current lines to the magnetic roller 40*b*.

Incidentally, the alternating voltage shutoff unit 403 according to the embodiment of this disclosure is configured so as to stop applying the second alternating voltage to the magnetic roller 40*b* using the insulator 608; however, the alternating voltage shutoff unit 403 can be configured in other way. For example, if the discharge starting voltage is measured when replacing the sleeve roller 40*a* and magnetic roller 40*b* of a developer unit, a serviceman in charge of the replacement, instead of the alternating voltage shutoff unit 403, can operate (insert) the insulator 608 to stop application of the second alternating voltage to the magnetic roller 40*b*.

In addition, if measurement of the discharge starting voltage is performed only at the time of maintenance, the insulator 608 can be configured to be detachable and a service man inserts the insulator 603 only at the time of maintenance.

Although the developer bias application unit 402 in this embodiment of the disclosure is implemented as hardware, it can be implemented as software.

Although this embodiment is made assuming that the image forming apparatus employs a touchdown development system, any types of image forming apparatus can be used as long as it includes a development device using two-component developer.

Although the above description of the disclosure describes a black (BK) development device as an example, the disclosure can be applied to other color development devices, such as yellow (Y), magenta (M), and cyan (C) development devices.

Furthermore, although the image forming apparatus 1 is configured to include the above-described units in the present embodiment, this disclosure can be offered in the form of a recording medium that stores a program for implementing the units. In this form, the image forming apparatus 1 is configured to read out the program to implement the respective units. In this case, the program read out of the recording medium performs the operation and produces the effect of the present disclosure. Furthermore, the present disclosure can be offered as a method for storing steps performed by each unit into a hard disk.

As described above, the image forming apparatus and the method for measuring discharge starting voltage according to the present disclosure are useful to not only multifunctional peripherals, but also copiers, printers, etc., and can be effectively used to measure discharge starting voltage correctly by switching between voltage/current lines to the magnetic roller.

What is claimed is:

1. An image forming apparatus including an alternating transformer that splits a given alternating voltage into a first alternating voltage and a second alternating voltage, comprising:

a developer bias application unit that, during image formation, applies to a sleeve roller a pulsed sleeve roller voltage composed of a first alternating voltage superimposed on a first direct voltage, and also applies to a magnetic roller a second alternating voltage and a second direct voltage separately in order to apply to the magnetic roller a pulsed magnetic roller voltage composed of the second alternating voltage superimposed on the second direct voltage;

an alternating voltage shutoff unit that stops applying the second alternating voltage to the magnetic roller before measurement of discharge starting voltage; and a discharge starting voltage measurement unit that when the application of the second alternating voltage to the magnetic roller is stopped, increases the given alternating voltage of the alternating transformer to measure the discharge starting voltage that occurs between the sleeve roller and the magnetic roller.

2. The image forming apparatus according to claim 1 wherein a given insulating member is provided between a direct voltage line through which the second direct voltage is applied to the magnetic roller and an alternating voltage line through which the second alternating voltage is applied to the magnetic roller.

3. A method for measuring discharge starting voltage of an image forming apparatus that includes an alternating transformer that splits a given alternating voltage into a first alternating voltage and a second alternating voltage, the method comprising the steps of:

during image formation, applying to a sleeve roller a pulsed sleeve roller voltage composed of a first alternating voltage superimposed on a first direct voltage and also applying to a magnetic roller a second alternating voltage and a second direct voltage separately in order to apply to the magnetic roller a pulsed magnetic roller voltage composed of the second alternating voltage superimposed on the second direct voltage;

stopping applying the second alternating voltage to the magnetic roller before measurement of discharge starting voltage; and when the application of the second alternating voltage to the magnetic roller is stopped, increasing the given alternating voltage of the alternating transformer to measure the discharge starting voltage that occurs between the sleeve roller and the magnetic roller.

* * * * *